US006113480A

United States Patent [19]

Hu et al.

[11] Patent Number: 6,113,480

[45] Date of Patent: Sep. 5, 2000

[54] APPARATUS FOR POLISHING SEMICONDUCTOR WAFERS AND METHOD OF TESTING SAME

[75] Inventors: T. J. Hu, Ping Ting; C. N. Chuan, Kao-hsiung, both of Taiwan

[73] Assignee: Taiwan Semiconductor Manufacturing Co., Ltd, Hsin-chu, Taiwan

[21] Appl. No.: 09/088,953

[22] Filed: Jun. 2, 1998

[51] Int. Cl.[7] ..... B24B 29/00

[52] U.S. Cl. ..... 451/289; 451/388

[58] Field of Search ..... 451/398, 388, 451/287, 288, 289, 8, 41

[56] References Cited

U.S. PATENT DOCUMENTS

| | | | |
|---|---|---|---|
| 5,527,209 | 6/1996 | Volodarsky et al. | 451/388 |
| 5,584,751 | 12/1996 | Kobayashi et al. | 451/288 |
| 5,643,061 | 7/1997 | Jackson et al. | 451/289 |
| 5,803,799 | 9/1998 | Volodarsky et al. | 451/288 |
| 5,913,718 | 6/1999 | Shendon | 451/288 |
| 5,916,015 | 6/1999 | Natalicio | 451/288 |

*Primary Examiner*—Timothy V. Eley
*Assistant Examiner*—Dung Van Nguyen
*Attorney, Agent, or Firm*—Tung & Associates

[57] ABSTRACT

A semi-conductor wafer polishing head includes three air lines for controlling three respective head functions, and an air control system providing precise head control and functional checking of each head sub-system, including air line pressure checking and chamber leak rate testing. The control system includes electrically operated valves for selectively coupling air chambers in the head with either a source of pressurized air, a source of negative air pressure, or a vent to atmosphere. A pair of air gauges are employed to check chamber leak rate respectively during positive and negative air pressure tests.

15 Claims, 2 Drawing Sheets

APPARATUS FOR POLISHING SEMICONDUCTOR WAFERS AND METHOD OF TESTING SAME

TECHNICAL FIELD

The present invention broadly relates to apparatus for polishing semiconductor wafers, and deals more particularly with a system for controlling a wafer polishing head, as well as to a method of testing the same.

BACKGROUND OF THE INVENTION

Apparatus for polishing thin, flat semi-conductor wafers is well-known in the art. Such apparatus normally includes a polishing head which carries a membrane for engaging and forcing a semi-conductor wafer against a wetted polishing surface, such as a polishing pad. Either the pad, or the polishing head is rotated and oscillates the wafer over the polishing surface. The polishing head is forced downwardly onto to the polishing surface by a pressurized air system or, similar arrangement. The downward force pressing the polishing head against the polishing surface can be adjusted as desired. The polishing head is typically mounted on an elongated pivoting carrier arm, which can move the pressure head between several operative positions. In one operative position, the carrier arm positions a wafer mounted on the pressure head in contact with the polishing pad. In order to remove the wafer from contact with the polishing surface, the carrier arm is first pivoted upwardly to lift the pressure head and wafer from the polishing surface. The carrier arm is then pivoted laterally to move the pressure head and wafer carried by the pressure head to an auxiliary wafer processing station. The auxiliary processing station may include, for example, a station for cleaning the wafer and/or polishing head; a wafer unload station; or, a wafer load station.

More recently, chemical-mechanical polishing (CMP) apparatus has been employed in combination with a pneumatically actuated polishing head. CMP apparatus is used primarily for polishing the front face or device side of a semi-conductor wafer during the fabrication of semiconductor devices on the wafer. A wafer is "planarized" or smoothed one or more times during a fabrication process in order for the top surface of the wafer to be as flat as possible. A wafer is polished by being placed on a carrier and pressed face down onto a polishing pad covered with a slurry of colloidal silica or alumina in de-ionized water.

A polishing pad is typically constructed in two layers overlying a platen with the resilient layer as the outer layer of the pad. The layers are typically made of polyurethane and may include a filler for controlling the dimensional stability of the layers. The polishing pad is usually several times the diameter of a wafer and the wafer is kept off center on the pad to prevent polishing a non-planar surface onto the wafer. The wafer is rotated to prevent polishing a taper into the wafer. Although the axis of rotation of the wafer and the axis of rotation of the pad are not collinear, the axes must be parallel.

Polishing heads of the type described above used in the CMP process are shown in U.S. Pat. No. 4,141,180 to Gill, Jr., et al.; U.S. Pat. No. 5,205,082 to Shendon et al; and, U.S. Pat. No. 5,643,061 to Jackson, et al.

It is known in the art that uniformity in wafer polishing is a function of pressure, velocity and the concentration of chemicals. Edge exclusion is caused, in part, by non-uniform pressure on a wafer. This problem is reduced somewhat through the use of a retaining ring which engages the polishing pad, as shown in the Shendon et al patent, however, consistency and reliability in achieving flatness and uniformity continues to be a problem, in part, because of the lack of control of the polishing head. Heretofore, the pneumatic control systems used in the polishing heads have been relatively unsophisticated, with little or no provision being made for precise control of air pressure applied to the subsystems of the head, and virtually no means provided for testing the head to ensure that all sub-systems are working properly, and within the desired specifications.

Accordingly, there is a clear need in the art for an improved CMP polishing head and method of testing same which overcomes each of the deficiencies discussed above.

SUMMARY OF THE INVENTION

According to one aspect of the invention, apparatus is provided for polishing a semi-conductor wafer using a polishing pad, comprising a polishing head and an air control system for precisely controlling and operating the head. The polishing head includes at least first and second air input lines for respectively controlling first and second operations of the head. The air control system includes first and second, electrically operated air control valves for controlling the flow of air to the first and second input lines of the head, an electronically operated master air control valve for controlling the delivery of air to each of the first and second control valves, and an electronic controller for independently controlling the operation of the first and second control valves as well as the master control valve.

The air control system also preferably includes an air pressure regulator for regulating the pressure of the air delivered to the master control valve. A first air gauge coupled immediately downstream of the master control valve provides an indication of the line pressure as well as an indication of air leakage during system tests. A second air gauge disposed between one of the control valves and the polishing head provides an indication of the rate of air leakage during both testing of the line under both positive and negative pressure conditions.

According to another aspect of the invention, apparatus provided for polishing a semi-conductor wafer using a polishing pad, which includes a head assembly including a membrane for contacting and forcing said wafer into face-to-face engagement with said pad, a retaining ring engaging said pad, a membrane chamber in said retaining ring and within which said membrane is disposed, a carrier having an air carrier chamber therein, a membrane air line for pressurizing said membrane chamber, a retaining ring air line for pressurizing said carrier chamber, a dechucking air line for applying pressure to said wafer through said membrane, and a control system for controlling the operation of said head assembly, said control system including a source of pressurized air, an air pressure regulator having an input coupled with said pressurized air source and an output for delivering regulated air, first, second and third electrically operated air control valves respectively coupled with and controlling the delivery of air to said membrane air line, said retaining ring air line and said dechucking air line, and a master control valve coupled between said air regulator and said first, second and third control valves.

According to still another aspect of the invention, a method is provided for testing an air driven, wafer polishing head of the type including a membrane for forcing the wafer against the polishing pad, and an air tight, membrane pressure chamber for applying force against the membrane. The method includes the steps of pressurizing the chamber using a source of pressurized air; checking the rate of air leakage from the chamber; depressurizing the chamber to create a partial vacuum in the chamber; and, checking the rate of air leakage from the chamber. Pressurization of the chamber is performed by operating a valve to an open position coupling the chamber with a source of pressurized air. Checking of the rate of air leakage is accomplished by monitoring an air gauge indicating the air pressure in the chamber. The chamber is depressurized by opening a second valve to place the chamber in communication with a source of negative air pressure.

According, it is a primary object of the present invention to provide a CMP type polishing head exhibiting improved processed control characteristics which result in superior wafer polishing, decreased down time and an increase in wafer yield.

Another object of the present invention is to provide a control system for a polishing head as described above which allows precise control over the pneumatic subsystems forming part of the head, as well as testing thereof to assure that all sub-systems are working within specified parameters.

A still further object of the invention is to provide a control system for a CMP polishing head of the type mentioned above which may be automatically controlled using a computer, such as a PLC operating under a set of programmed instructions.

Another object of the present invention is to provide a method of testing the operation of a pneumatically controlled system for a CMP polishing head which alerts the operator to problems or lack of readiness of the polishing head to function according to desired performance parameters.

These, and further objects and advantages of the invention, will be made clear or will become apparent during the course of the following description of a preferred embodiment chosen to illustrate the invention.

BRIEF DESCRIPTION OF THE DRAWINGS

In the drawings, which are to be read in conjunction with the present specification and appended claims, and wherein like reference numerals are employed to designate identical components in the various views:

THE DESCRIPTION OF THE PREFERRED EMBODIMENTS

Figure 1:
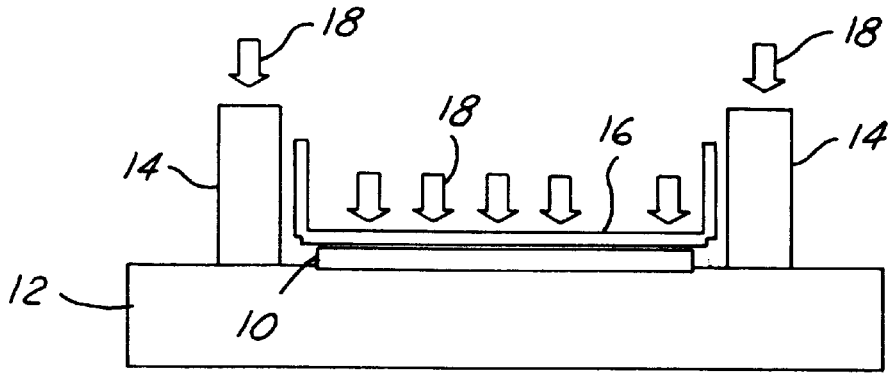
FIG. 1 is a diagrammatic view of the portion of a CMP polishing head, showing the relationship between the retaining ring, membrane, wafer and polishing pad.

Referring first to FIG. 1, the present invention relates to an improved CMP head, sometimes referred to as a Titan head which differs from conventional CMP heads in two major respects. First, the Titan head employs a compliant wafer carrier (to be discussed) and second, it utilizes a mechanical linkage (not shown) to constrain tilting of the head, thereby maintaining planarity relative to a polishing pad 12, which in turn allows the head to achieve more uniform flatness of the wafer during polishing.

The wafer 10 has one entire face thereof engaged by a flexible membrane 16, which biases the opposite face of the wafer 10 into face-to-face engagement with the polishing pad 12. The polishing head and/or pad 12 are moved relative to each other, in a circular fashion to effect polishing of the wafer 10. The polishing head includes an outer retaining ring 14 surrounding the membrane 16, which also engages the polishing pad 12 and functions to hold the head in a steady, desired position during the polishing process. As shown in FIG. 1, both the retaining ring 14 and the membrane 16 are urged downwardly toward the polishing pad 12 by a linear force indicated by the numeral 18 which is effected through a pneumatic system.

Figure 2:
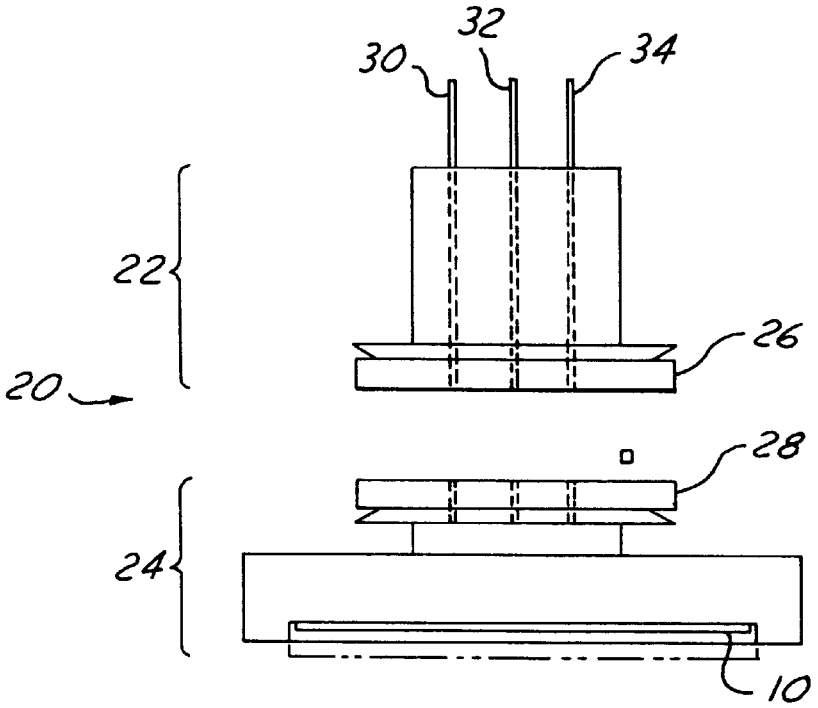
FIG. 2 is a front view of a CMP polishing head used with the present invention, depicting the upper part of the head released and elevated above the lower portion of the head.
Figure 3:
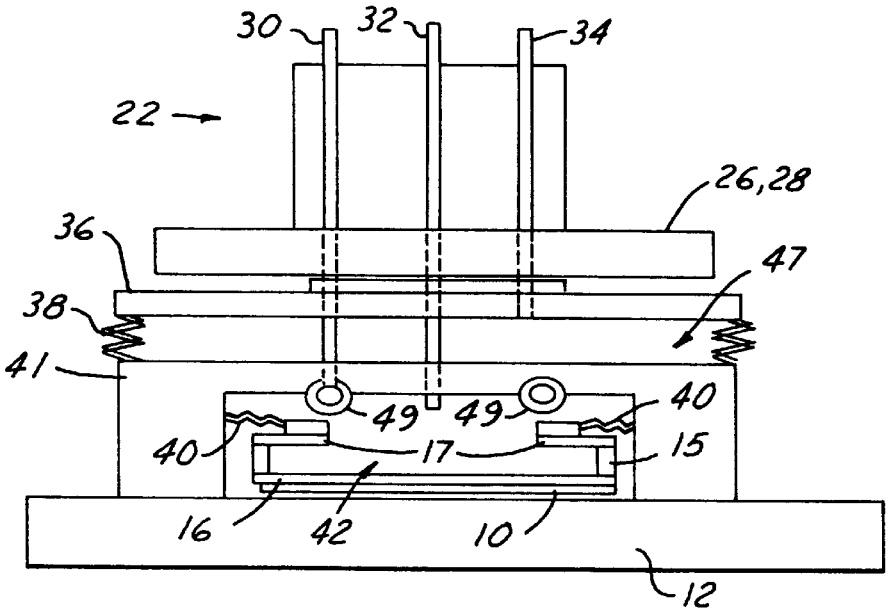
FIG. 3 is a cross-sectional view of the head shown in FIG. 2, but depicting the wafer and polishing pad; and, FIG. 4 is a combined schematic and diagrammatic view of the pneumatic control system for use with the polishing head depicted in FIGS. 2 and 3.

Referring now also to FIGS. 2 and 3, the polishing head, generally indicated by the numeral 20 in FIG. 2 comprises an upper, removable portion 22, and a lower portion 24 which are respectively provided with annular collars 26, 28 removably secured together by means of suitable clamps (not shown). The upper portion 22 of the head 20 is provided with three pneumatic lines 30, 32 and 34 which extend down through the upper collar portion 26 and are coupled with three corresponding extension lines in the lower portion 24 of the head 20. The lower portion 24 includes a main body 41 which may be formed of a plastic composite. The body 41 has a central opening on the bottom side thereof defining a membrane chamber 42, as best seen in FIG. 3. The sidewalls of the membrane chamber 42 define the retaining ring 14 described earlier with reference to FIG. 1. The membrane 16 is disposed within the chamber 42, in face-to-face contact with the wafer 10. Mounted on the outer periphery of the membrane 16, is an upstanding ring 15, having an inwardly extending, angularly shaped shoulder 17. Secured between the shoulders 17 and the inner sidewall of the body 41 is a flexible seal 40, formed of rubber or the like, which results in the membrane chamber 42 being air tight.

As best seen in FIG. 3, pneumatic line 32 extends down through the top side of the body 41 and communicates with the membrane chamber 42. Similarly, pneumatic line 30 extends down through the top side of the body 41 and communicates with an enclosed, ring-shaped bladder 49. Disposed immediately above the top of the body portion 41 is a platen 36 which is secured around its outer periphery by an accordion seal 38 to the top side of the body portion 41, thus forming a second, air tight retaining ring chamber 47 whose purpose will be discussed below. The third pneumatic line 34 extends down only through the collar portions 26, 28 and communicates with the retainer ring chamber 47.

Under normal operating conditions, the membrane chamber is pressurized by line 32, resulting in the membrane 16 forcing the wafer 10 against the polishing pad 42. The pressurized air in retaining ring chamber 47 delivered by pneumatic line 34 urges the body 41, and thus the retaining ring 14 downwardly into face-to-face contact with the polishing pad 12.

The compliant wafer carrier defined by the membrane 16 and retaining ring 14 described above allows the head 20 to conform to the back side of the wafer 12 and apply uniform pressure thereto. This eliminates the local hot spots and results in a more uniform polishing across the wafer 12. Under normal conditions, the pressures in chambers 42 and 47 are essentially equal. The pressure applied by the retaining ring 14 to the polishing pad 12 is a function of the pressure in both chambers 42 and 47.

When the polishing process is complete, the wafer 10 is removed from the polishing pad 12 in an operation sometimes referred to as a "dechuck" process. Dechuck is accomplished by the head 20 picking up the wafer 12 by causing the membrane 16 to act as a suction cup which holds on to the wafer 10 when the entire head 20 is moved away from the pad 12. During the dechuck process, it is crucial that the membrane 16 remains in good contact with the wafer 10, otherwise, the necessary suction action needed to retain the wafer 10 cannot be achieved. Consequently, in order to assure that the membrane 16 is forced downwardly onto the wafer 10, particularly along the edges thereof, air is supplied to the dechuck tube 30 which in turn fills the flexible bladder 49, causing the bladder 49 to engage the shoulder 17, thus applying a downward force along the periphery of the membrane 16. This peripheral pressure effectively produces a suction like action which retains the wafer 10 on the bottom on the membrane 16. Normally, the dechuck line 30 does not adversely affect the polishing process, since it is normally pressurized to the same pressure as the membrane chamber 42.

Figure 4:
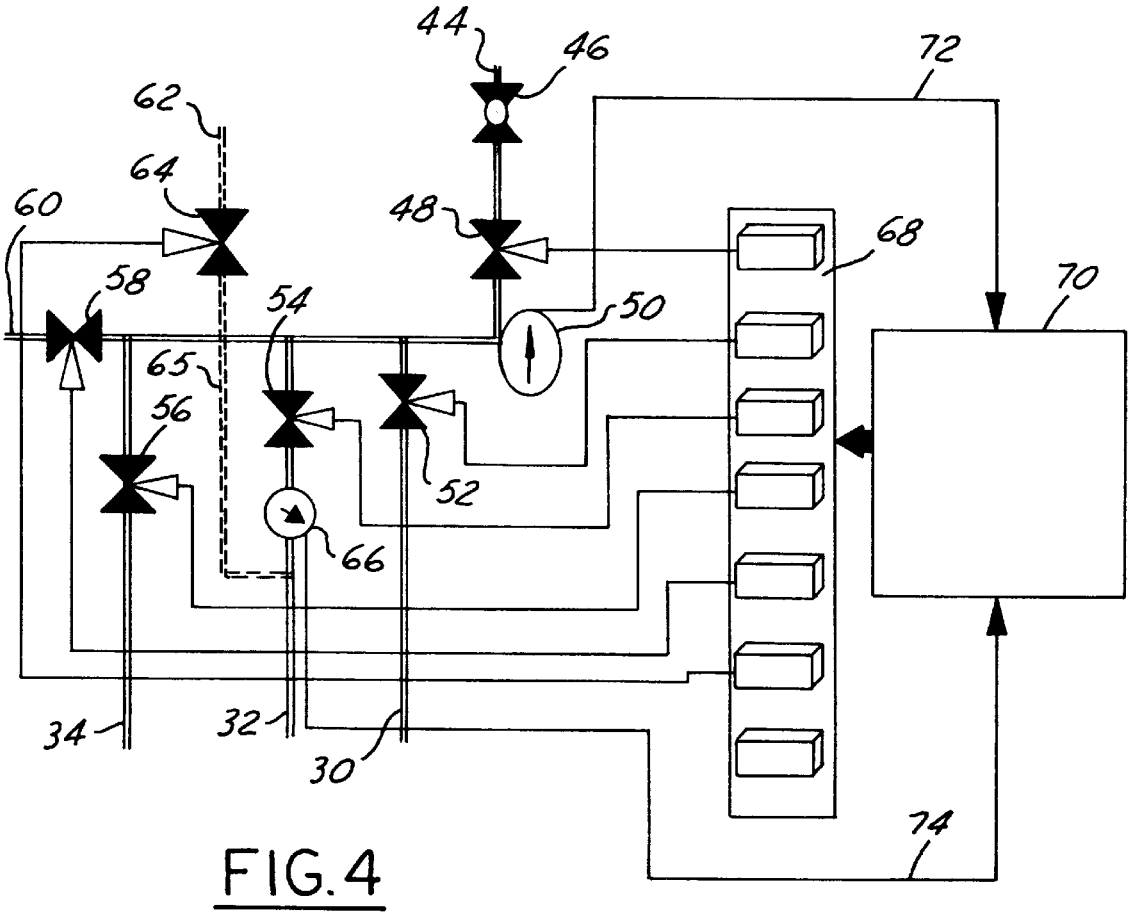

Reference is also now made to FIG. 4 which depicts the pneumatic control system for operating the processing head 20 described above. A series of electrically actuated air valves (to be described) are controlled by a bank of solenoids 68 which are in turn selectively energized by a programmed computer such as the PLC 70 (programmable logic controller). The PLC 70 controls the valves in accordance with a pre-program set of instructions (software), and based upon signals received on lines 72, 74 from a pair of air pressure gauges 50, 66. The programmed instructions for operating the PLC 70 will depend upon the exact details of the head 20 and application. These instructions are relatively simple and are well within the skill of the art; consequently, the details thereof need not be disclosed herein.

The pressured air from a suitable air pressure source is delivered at a pressurized air inlet 44 and is passed through an air regulator 46 to a master, solenoid controlled valve 48. The regulator 46 functions to regulate the pressure and quality of the air to the entire system. Master valve 48 allows the entire supply of air to the remaining portions of the system to be collectively shut off for purposes which will become later apparent. The previously mentioned air pressure gauge 50 is connected with the downstream side of the master valve 48. Downstream of the pressure gauge 50 is a manifold delivering the regulated air from the valve 48 to each of three solenoid operated control valves 52, 54 and 56 which respectively control the delivery of air to the dechuck tube 30, the membrane control line 32 and the retaining line 34.

Downstream of the valve 54, there is provided a vacuum line 65 which is selectively coupled through a solenoid control valve 64 to a vacuum port line 62. The vacuum port line 62 is coupled with a source of negative air pressure, such as an air pump. The previously mentioned pressure gauge 66 is coupled between the control valve 54 and vacuum line 65. Each of the control valves 52, 54, 56 is selectively coupled to a vent port 60 by means of a solenoid operated control valve 58. The vent port line 60 communicates with the ambient atmosphere.

Since the air gauge 50 is immediately downstream of the master valve 48, gauge 50 provides a signal on line 72 to the PLC 70 indicative of the air pressure being supplied to the control valve 52, 54 and 56. The arrangement described above with reference to FIG. 4 provides a highly flexible control system which is quite effective in testing and trouble-shooting the pneumatic portions of the head. A series of tests may be carried out to verify proper operation of the head and its various pneumatic sub-systems. For example, first, a test to assure proper supply of air pressure to the membrane chamber 42 may be carried out by first opening valves 48 and 54, which results in the flow of pressurized air from the air inlet 44 to the membrane control line 32, and then into the membrane chamber 42. At this point, the gauge 66 is read and the operator can check the condition of the membrane 16. Then, valves 48 and 54 are closed, whereupon the PLC 70 takes a reading from the pressure gauge 66 to determine the rate at which air may be leaking from the membrane chamber 42. Next, valve 64 is opened, thus placing the membrane chamber 42 in communication with the vacuum port line 62. The normal pressure in chamber 42 is, for example, about 4 psi, whereas the negative pressure in vacuum port line 62 may be become, for example, −5 psi. The gauge 66 is again read to determine the low pressure leak rate from the chamber 42. Following the test described immediately above, valve 64 is actuated to a closed position, and valves 54 and 58 are opened, thereby coupling the membrane chamber 42 to the vent port 60.

A similar test can be performed to check the operational state of the retaining ring and retaining ring chamber 47. This test is performed as follows. First, master valve 48 and vent valve 58 are both opened. This test determines whether the retaining ring is moving. Then, the master valve 48 is closed and the PLC 70 reads the pressure gauge 50. This test provides an indication of the leak rate from the retaining ring chamber 47. Finally, the air vent valve 58 is opened.

A test of the dechuck tube 30 is performed by first opening the master valve 48 and control valve 52; this results in pressurization of the dechuck 30. Then, valve 52 is closed and the PLC 70 takes a reading from the pressure gauge 50 which is indicative of the leak rate of the dechuck tube 30. Finally, valve 58 is opened to vent the pressure to atmosphere.

Since the chambers 42, 47 are disposed within the same head adjacent to each other, a possibility exists that air may leak between these two chambers or between portions of the various, related pneumatic tubes. In order to test whether any such "cross talk" may exist, a further test may be performed as follows. First, valves 48, 52 and 56 are opened, thereby pressurizing the retaining ring chamber 47 and the dechuck tube 30. Then, a master valve 48 is closed and the PLC 70 reads the air pressure gauge 66 which provides an indication of whether there may be any cross talk between these two sub-systems. The test is completed by opening the vent port valve 58 to empty the lines to atmosphere.

From the foregoing, it is apparent that the improved polishing apparatus and method of testing same described above not only provide for the reliable accomplishment of the objects of the invention but do so in an particularly effective and economical manner. It is recognized, of course, that those skilled in the art may make various modifications or additions to the preferred embodiment chosen to illustrate the invention without departing from the spirit and scope of the present contribution to the art. Accordingly, it is to be understood that the protection sought and to be afforded hereby should be deemed to extend to the subject matter claimed and all equivalents thereof fairly within the scope of the invention.

What is claimed is:

1. Apparatus for polishing a semi-conductor wafer using a polishing pad, comprising:

a polishing head having at least first and second air input lines for controlling at least first and second operations of said head; and an air control system, including:

(a) at least first and second electrically operated air control valves for respectively controlling the flow of air to said first and second input lines, (b) an electrically operated master control valve for controlling the flow of air to each of said first and second control valves, (c) an air pressure regulator having an input for receiving an unregulated supply of air, and an output for delivering regulated air to said master control valve, (d) an electronic controller for independently controlling the operation of said first and second control valves and said master control valve.

2. The apparatus of claim 1, wherein said air control system includes an air pressure gage coupled between said master control valve, said first and second control valves for gauging the pressure of the air delivered to said first and second control valves.

3. The apparatus of claim 2, wherein said air control system includes:

an air vent line, and a third electrically operated air control valve coupled between said air vent line and said first and second control valves for allowing venting of air from said first and second air input lines.

4. The apparatus of claim 1, wherein said air control system includes:

an air pressure gage coupled between said second control valve and said second air input line, a vacuum air port, and an electronically operated, vacuum air port control valve for selectively coupling said second line with said vacuum air port.

5. The apparatus of claim 1, wherein said air controller system includes:

first air pressure gauge coupled between said master control valve, and said first and second control valves, a second air pressure gauge coupled between said second control valve and said second air input line, a vacuum port, and a third electrically operated air control valve coupled between said second air input line and said vacuum port, for selectively coupling said second input line to said vacuum port.

6. The apparatus of claim 5, wherein said air control system includes:

a vent port, and a fourth electrically operated air control valve coupled with said first and second control valves for selectively coupling said first and second air input lines with said vent port.

7. The apparatus of claim 6, wherein said air control system includes an air inlet, and an air pressure regulator coupled between said air inlet and said master control valve.

8. The apparatus of claim 1, wherein said polishing head includes:

a membrane for engaging said wafer, a membrane air chamber coupled with said second air input line for containing pressurized air, the pressure in said membrane air chamber urging said membrane to force said wafer against said pad.

9. The apparatus of claim 8, wherein said polishing head includes:

a retaining ring for retaining said membrane in a desired position relative to said pad and said wafer, and a retaining ring air chamber coupled with said first air input line for containing pressurized air, the air pressure in said retaining ring chamber biasing said retaining ring into engagement with said pad.

10. Apparatus for polishing a semi-conductor wafer using a polishing pad, comprising:

a head assembly including (a) a membrane for contacting and forcing said wafer into face-to-face engagement with said pad, (b) a retaining ring engaging said pad, (c) a membrane chamber in said retaining ring and within which said membrane is disposed, (d) a carrier having an air chamber therein, (e) a membrane air line for pressurizing said membrane chamber, (f) a retaining ring air line for pressurizing said carrier chamber, (g) a dechucking air line for applying pressure to said wafer through said membrane; and a control system for controlling said head assembly, said control system including (a) a regulator for delivering regulated air, (b) first, second and third electrically operated air control valves respectively coupled with and controlling the delivery of air to said membrane air line, said retaining ring air line and said dechucking air line, and (c) a master control valve coupled between said air regulator and said first, second and third control valves.

11. The apparatus of claim 10, wherein said control system includes a first air pressure gauge coupled between said master control valve and first, second and third control valves.

12. The apparatus of claim 11, wherein said control system includes a second air pressure gauge coupled between membrane air line and said first control valve.

13. The apparatus of claim 10, wherein said control system includes:

a vacuum port, and a fourth electrically operated air control valve controlling the flow of air from said membrane air line to said vacuum port.

14. The apparatus of claim 13, wherein said control system includes:

a vent port, and a fifth electrically operated air control valve for controlling the flow of air from said membrane air line and said dechucking line to said vent port.

15. The apparatus of claim 10, wherein said control system includes:

a vent port, and a fourth electrically operated air control valve for controlling the flow of air from said membrane air line to said vent port.

* * * * *